United States Patent [19]

Myers et al.

[11] Patent Number: 4,605,272

[45] Date of Patent: Aug. 12, 1986

[54] HIGH VOLTAGE ELECTRICAL CONNECTOR

[75] Inventors: Melvin K. Myers; Frank Pospisil, both of Los Angeles, Calif.

[73] Assignee: Reynolds Industries, Inc., Los Angeles, Calif.

[21] Appl. No.: 696,899

[22] Filed: Feb. 1, 1985

Related U.S. Application Data

[63] Continuation of Ser. No. 142,976, Apr. 21, 1980, abandoned, which is a continuation of Ser. No. 936,642, Aug. 24, 1978, abandoned.

[51] Int. Cl.[4] ..... H01R 13/52

[52] U.S. Cl. ..... 339/60 M

[58] Field of Search ..... 339/59 R, 59 M, 60 R, 339/60 C, 60 M, 89 C, 94 R, 94 C, 94 M, 177 R, 143 R

[56] References Cited

U.S. PATENT DOCUMENTS

| | | | |
|---|---|---|---|
| 2,448,509 | 9/1948 | Antony, Jr. et al. | 339/60 C |
| 2,782,391 | 2/1957 | Kirk | 339/94 R |
| 2,874,206 | 2/1959 | Bowers et al. | 339/94 C |
| 3,375,483 | 3/1968 | Phillips | 339/143 R |
| 3,514,741 | 5/1970 | Noren | 339/60 C |
| 3,588,783 | 6/1971 | Newman | 339/59 M |
| 3,629,792 | 12/1971 | Dorell | 339/60 M |
| 3,842,393 | 10/1974 | Glover et al. | 339/60 M |
| 3,937,545 | 2/1976 | Cairns et al. | 339/60 R |
| 3,994,553 | 11/1976 | Kornick | 339/60 R |
| 4,090,759 | 5/1978 | Herrmann, Jr. | 339/60 M |
| 4,417,736 | 11/1983 | Herrmann, Jr. | 339/60 M |

*Primary Examiner*—Neil Abrams

*Attorney, Agent, or Firm*—Pretty, Schroeder, Brueggemann & Clark

[57] ABSTRACT

An electrical connector having a receptacle assembly and a plug assembly with electrically connectable contact pins, from which atmospheric air is essentially excluded by an arrangement of dielectric seals. A first contact pin, in the plug assembly, is encased by a first dielectric sleeve of relatively non-resilient material, and a second dielectric sleeve, of resilient material, is installed in the receptacle assembly and is dimensioned to provide a continuous dielectric seal between the first dielectric sleeve and the body of the receptacle assembly, which is also of a dielectric material. The connector is coupled by inserting the first dielectric sleeve of the plug assembly into the second dielectric sleeve of the receptacle assembly, thereby completing the continuous dielectric seal, but avoiding abrasive contact with the receptacle body and minimizing the axial force needed to effect coupling and uncoupling.

20 Claims, 4 Drawing Figures

HIGH VOLTAGE ELECTRICAL CONNECTOR

This application is a continuation of application Ser. No. 142,976, filed Apr. 21, 1980, and now abandoned, which is a continuation of application Ser. No. 936,642, filed Aug. 24, 1978, and now abandoned.

BACKGROUND OF THE INVENTION

This invention relates generally to high-voltage electrical connectors, and, more particularly, to high-voltage connectors having dielectric seals around their electrically connectable contact pins. High-voltage connectors are used in a variety of devices. For example, in coupling a high-voltage power supply to a traveling-wave tube, a connector rated as high as 20 kv may be required. Such a connectcr may, for example, effect connection of a single high-voltage conductor and a surrounding ground conductor, but in other types of connectors, multiple pins may be involved.

In the design of high-voltage connectors of this general type, electrical arcing and corona discharge must be eliminated, or at least minimized. One technique for achieving this goal is to surround the connector contact pins with a dielectric material, thereby isolating the connector from the surrounding atmosphere. Unfortunately, however, the use of dielectric materials, such as natural or synthetic rubber, usually results in significant difficulty in coupling and uncoupling the constituent parts of the connector.

Typically, a high-voltage connector comprises a receptacle assembly and a plug assembly. The receptacle assembly has an insultated body, usually of a ceramic material, and includes a male contact pin recessed relatively deeply inside a cylindrical bore within the insulated body. The plug assembly includes a female contact pin with a bore in its end sized to receive and retain the male contact pin of the receptacle assembly.

In a typical connector of the prior art, a dielectric seal, of rubber or similar material, encases the contact pin on the plug assembly, except for an end hole in which the male pin of the receptacle assembly is inserted. When the connector is assembled, the contact pin in the plug assembly, including the surrounding rubber dielectric seal, is crammed inside the ceramic insulated body of the receptacle assembly, and a lock nut is engaged to retain the two halves of the connector in an assembled relationship.

Unfortunately, however, this type of connector structure has a number of significant disadvantages. Most importantly, connectors of this type simply do not have good performance characteristics at low temperatures and low pressures, such as might be encountered at high altitude in some applications. It has been theorized that some corona discharge still occurs in air gaps around the contact pins. Another disadvantage is that the ceramic material usually used for the insulated receptacle body is an abrasive material, and this results in significant wear on the rubber dielectric seal. In some instances, as few as ten or twelve matings of the connector can have a significant effect on its performance.

In addition, the inner ceramic surface of the receptacle assembly can become soiled by repeated matings with the rubber dielectric seal, and this may also have a detrimental effect on the operation of the connector. Also significant from a wear standpoint, is the abrasive action of a threaded portion of the ceramic insulated body, as it engages the threads of the lock nut.

Another important consideration is that the coupling action requires a relatively large axial force to be applied between the plug and receptacle assemblies, and damage may result to the connections between the conductors and the contact pins of the connector. Such damage can also result from the uncoupling action.

Many of these disadvantages are aggravated when the connector is subjected to low temperatures, and the rubber dielectric material becomes less resilient, more brittle, and more susceptible to wear. Coupling the plug and receptacle assemblies together at low temperatures is particularly difficult and often results in damage to the dielectric material.

It will be appreciated from the foregoing that there is a significant need for an improved high-voltage electrical connector that avoids the aforementioned disadvantages of the prior art, and that provides a connector operable even at low temperatures anmd pressures, and capable of being coupled several hundred times without significant wear. The present invention fulfills this need.

SUMMARY OF THE INVENTION

The present invention resides in a high-voltage connector in which the contact pins are dielectrically sealed in such a manner as to effectively isolate them from the atmosphere, while at the same time providing for convenient and non-abrasive coupling and uncoupling actions. Basically, and in general terms, the improved connector of the invention includes a first dielectric sleeve of relatively non-resilient material, permanently installed over the plug contact pin, and a second dielectric sleeve of resilient material installed in the insulated body of the receptacle assembly, the two dielectric sleeves being dimensioned such that the resilient dielectric sleeve forms a continuous dielectric seal between the first dielectric sleeve and the insulated body of the receptacle.

The first dielectric sleeve is of a relatively smooth and hard-wearing material, and slides tightly but easily inside the second dielectric sleeve, compressing it against the insulated body of the receptacle. For more perfect sealing, the second dielectric sleeve has one or more integral raised annular portions on its outer surface, its inner surface, or both. The second dielectric sleeve may also have an integral annular flange around its outer surface, to be received in a corresponding annular groove formed inside the insulated body of the receptacle. The flange and groove act to prevent inadvertent removable of the second dielectric sleeve. The first dielectric sleeve has a small central aperture in its end, for receiving the male connector pin installed in the receptacle assembly of the connector, and the second dielectric sleeve has a similar. opening in its end wall for the same purpose.

It will be appreciated from the foregoing that the invention allows convenient connection and disconnection of a high-voltage conductor, and that it does so without significant wear to the connector parts, since the sliding contact during connection and disconnection is between the relatively smooth first dielectric sleeve and the inner surface of the second dielectric sleeve. Furthermore, the contact pins of the connector are essentially perfectly sealed by surrounding dielectric elements. Other aspects and advantages of the invention will become apparent from the following more detailed description, taken in conjunction with the accompanying drawings.

DESCRIPTION OF THE PREFERRED EMBODIMENT

Figures 1, 2, 3:
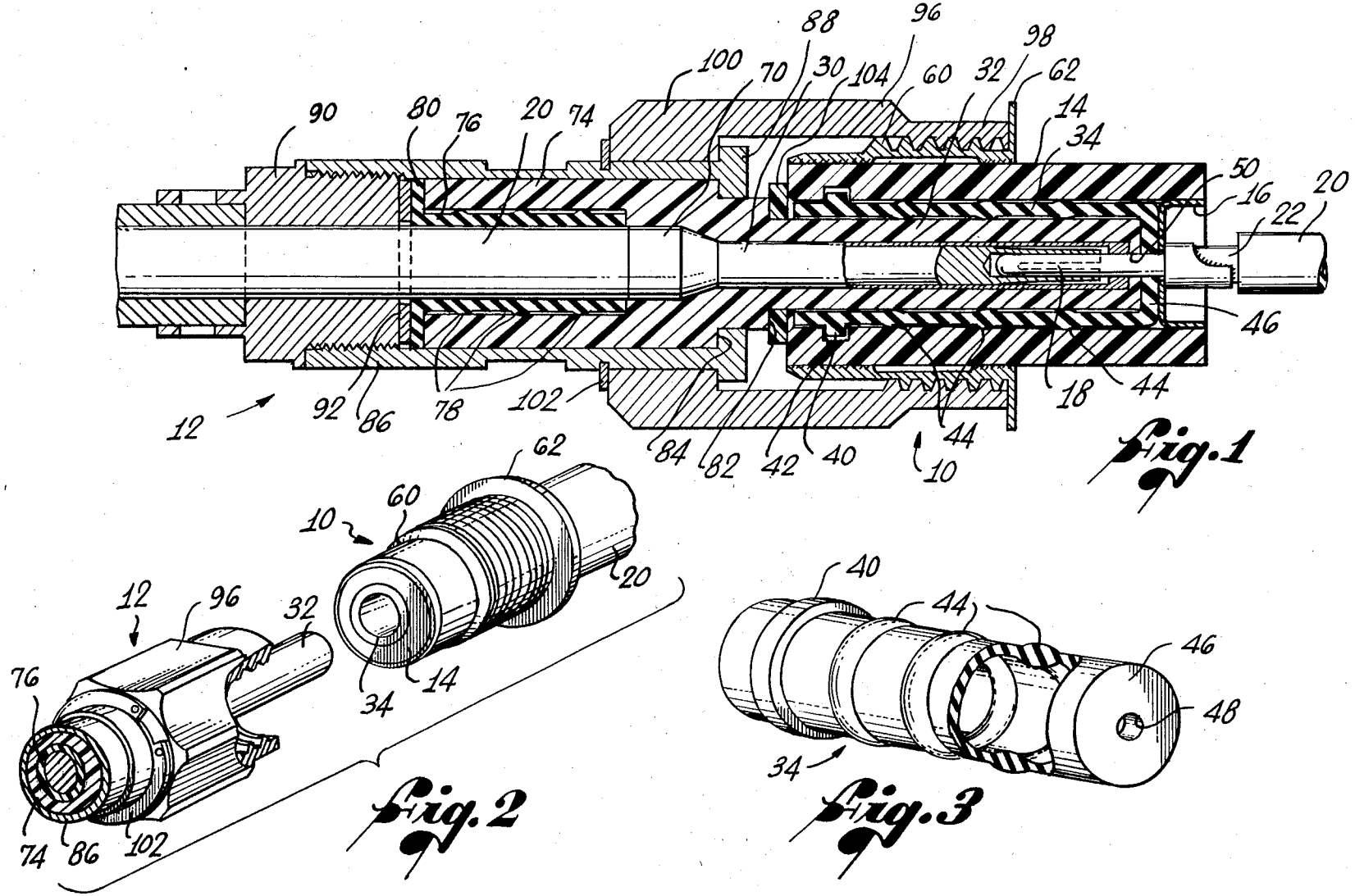
FIG. 1 is a longitudinal cross-sectional view of the connector shown in an assembled condition.
FIG. 2 is a perspective view of the connector of FIG. 1, shown with the plug and receptacle assemblies disconnected, and at a reduced scale compared with that of FIG. 1.
FIG. 3 is a perspective view, partly in section, of the resilient dielectric sleeve used in the connector of the invention.

As shown in the drawings, the present invention relates to a high-voltage electrical connector. Basically, a connectcr of the type with which the present invention is concerned comprises a receptacle assembly, generally indicated by reference numeral 10, and a plug assembly 12. The receptacle and plug assemblies include equal numbers of electrically conductive contact pins, corresponding ones of which are coupled together when the receptacle and plug assemblies are connected. In the embodiment illustrated, only a single pair of such contact pins is shown, as will now be described in more detail, but it will be appreciated that the invention is equally applicable to multi-pin connectors as well.

The receptacle assembly 10 of the connector comprises a generally cylindrical insulated body 14, usually of a ceramic material, the insulated body having a metal insert 16 securely installed at one end of the body, and adapted to support a male contact pin 18 in such a manner that the pin extends axially toward the other end of the body. An electrical cable 20 has an insulated conductor 22 that is soldered or otherwise electrically connected to the contact pin 18. The plug assembly 12 includes an elongated female contact pin 30 taking the form of a sleeve at its end, the sleeve being designed to receive and make electrical contact with the male contact pin 18 of the receptacle assembly 10. The contact pin 30 is appropriately connected, by soldering or other means, to an insulated electrical cable 20', so that when the contact pins 18 and 30 are coupled together, electrical connection is established between the cables 20 and 20', through the connector.

For operation of the connector at high voltages, up to approximately 20 kv, it is important not only to establish good electrical connection between the contact pins 18 and 30 of the connector, but also to isolate, as far as possible, the connector from exposure to atmospheric air, to eliminate, or at least minimize, sparking and corona discharges from the electrically conductive elements. Such isolation is usually effected by surrounding the conductive elements with a dielectric material, and this becomes even more important in conditions of reduced atmospheric pressure and reduced temperature. Previous attempts to address these problems have required that the female contact pin 30 be surrounded with a resilient dielectric material, which is then forced into the interior of the insulated body 14, to minimize air gaps around the pin 30.

In accordance with the present invention, the space between the female contact pin 30 and the insulated body 14 of the receptacle assembly 10 is filled by two closely adjacent dielectric sleeves. A first dielectric sleeve 32 is permanently installed over the female contact pin 30, and is of relatively non-resilient and smooth material. A second dielectric sleeve 34 is installed inside the insulated body 14, and is made of a resilient material, such as a silicone rubber. When the pin 30 and its outer dielectric covering 32 are together inserted in the receptacle assembly 10, the second dielectric sleeve 34 is radially compressed within the insulated body 14, and forms a practically perfect seal between the first dielectric sleeve 32 and the dielectric material of the insulated body 14. As a result, practically all atmospheric air is excluded from contact with the female contact pin 30.

In the connector of the invention, the plug assembly 12 can be inserted in the receptacle assembly 10 relatively easily, thus minimizing the problems of abrasion and wear that would otherwise result from contact with the ceramic insulated body 14. The sliding contact between the mating elements, during coupling and uncoupling of the connector, is between the first dielectric sleeve 32 and the second dielectric sleeve 34. The first dielectric sleeve 32 is preferably a hard-wearing plastic material with a relatively low coefficient of friction, such as diallyl phthalate, to minimize wear from the coupling and uncoupling operations.

It will be best appreciated from FIG. 3 that the resilient dielectric sleeve 34 of the preferred embodiment includes an annular flange 40, which is received in a corresponding annular notch 42 in the insulated body 14, to prevent inadvertent removal of the resilient sleeve 34. The resilient sleeve 34 of the preferred embodiment also includes a plurality of raised annular portions 44 spaced along its length, both on the inside and outside surfaces of the sleeve. When the plug assembly 12 is inserted in the receptacle assembly 10, these raised annular portions 44 are compressed between the first dielectric sleeve 32 and the inner surface of the insulated body 14, to provide a more perfect seal.

The resilient sleeve 34 is, of course, open at one end to receive the female contact pin 30 and the first dielectric sleeve 32 of the plug assembly 12, and has its other end closed by an integral end wall 46, having a central circular opening 48 through which the male contact pin 18 is inserted in the coupling action. The male pin 18 also extends through a corresponding opening 50 in the end of the first dielectric sleeve 32.

In the embodiment illustrated, a shielded grounding path is also provided in the connector. The insulated body 14 of the receptacle assembly 10 has affixed to it an externally threaded metallic bushing 60. The bushing 60 forms the exterior of the leading portion of the receptacle assembly 10, and has an integral flange 62 to which a shielded ground conductor (not shown) is electrically connected.

The plug assembly 12 also includes, in addition to the female contact pin 30 and the first dielectric sleeve 32, other elements for housing these elements and for retainihg the plug and receptacle assemblies 10 and 12 in connection. The female contact pin 30 terminates at its root end in an enlarged-diameter portion 70, at which electrical connection is made with the cable 20'. The non-resilient dielectric sleeve 32 is dimensioned to surround the pin 30 closely, including the enlarged-diameter portion 70. The non-resilient dielectric sleeve 32 has its internal diameter further enlarged, as shown at 74, to surround an end portion of the cable 20', but leaving an annular gap between itself and the cable . This gap is filled by a resilient seal 76, preferably of a silicone rubber material, and having raised annular portions 78 on its exterior surface. The seal 76 has an integral, outwardly extending end flange 80, which overlaps the end of the first dielectric sleeve 32, at its enlarged-diameter Portion 74. The dielectric sleeve 32 also has two external diameter changes, a first enlargement in diameter forming an external shoulder 82 near the root of the female contact pin 30, and a second diameter enlargement forming another external shoulder 84 to the rear of the first external shoulder 82.

The first dielectric sleeve 32 is installed in a metallic cylindrical housing 86, having essentially the same diameter internally as the external diameter of the enlarged portion 74 of the first dielectric sleeve 32. The metallic housing 86 has an integral end flange 88 at its forward or leading end, extending inwardly over the external shoulder 84 of the dielectric sleeve 32, and also extending outwardly for a short distance. The housing 86 is internally threaded at its rearward end to receive a correspondingly threaded plug 90, which functions to retain the non-resilient dielectrical sleeve 32 in position by urging it against the inwardly projecting portion of the housing flange 88. The seal 76 is also held in position by the plug 90 as it bears down on the flange 80 of the seal. An annular spacer 92 may be included between the plug 90 and the flange 80 of the seal 76.

Finally, the connector includes a lock nut 96 having an internally threaded forward end 98, and an internally flanged rear end portion 100, which is retained between the housing flange 88 and a snap ring 102 installed around the housing 86. The lock nut 96 engages the threaded portion of the bushing 60 on the receptacle assembly 10, and retains the plug assembly 12 in connection with the receptacle assembly. A resilient annular seal 104 is installed between the leading edge of the insulated body 14 and the external shoulder 82 of the first dielectric sleeve 32, to complete sealing of the connector.

Figure 4:
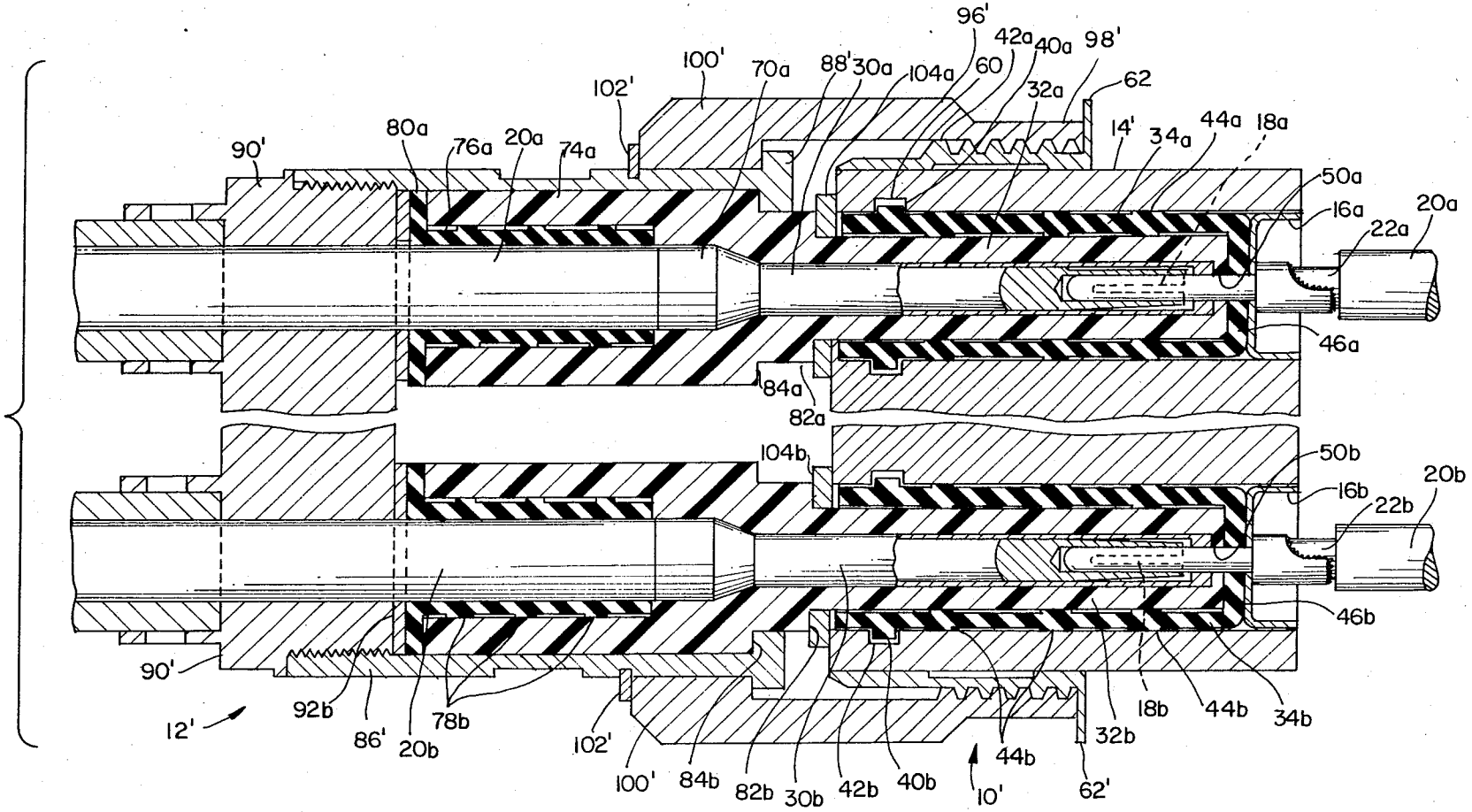
FIG. 4 is a longitudinal cross-sectional view of a connector embodiment that includes multiple pairs of mating electrical contacts.

FIG. 4 is a longitudinal cross-sectional view of an alternative connector embodiment, which includes multiple pairs of mating electrical contacts. Two such pairs of contacts are depicted. It will be noted that the various elements associated with each pair of contacts are substantially identical in structure and function to the elements depicted in the single-pin connector of FIG. 1. The elements of FIG. 4 that are duplicated for the two pairs of contacts are identified by the same reference numerals as the corresponding elements of FIG. 1, but with the added suffix a or b.

It will be appreciated from the foregoing that the present invention represents a significant improvement in high-voltage electrical connectors. In particular, the invention provides a connector from which atmospheric air is essentially excluded by an arrangement of dielectric seals that also allows for convenient coupling and uncoupling without excessive wear. It will also be appreciated that the invention is equally applicable to multi-pin connectbrs, and to both shielded and unshielded connectors, and that various other modifications may be made without departing from the spirit and scope of the invention. Accordingly, the invention is not to be limited except as by the appended claims.

We claim:

1. In a high-voltage electrical connector having a receptacle assembly and a plug assembly, each assembly having at least one electrical contact pin, the improvement comprising:

a receptacle body of relatively non-resilient dielectric material having a cylindrical inner surface;

a first cylindrical dielectric sleeve, of smooth, relatively non-resilient material, included in the plug assembly and encasing a first contact pin in the plug assembly; and a sedond cylindrical dielectric sleeve, of resilient and relatively thin-walled material, installed in said receptacle body surrounding a second contact pin therein, said second dielectric sleeve's wall thickness being substantially less than its inner radius;

wherein said second cylindrical dielectric sleeve includes a plurality of inner raised annular portions on its inner surface and an equal plurality of outer raised annular portions on its outer surface, each of said inner raised annular portions being located immediately opposite a corresponding outer raised annular portion, along a line normal to the sleeve axis; and wherein said first dielectric sleeve is dimensioned to slide tightly but easily inside said second dielectric sleeve, such that oney the inner and outer raised annular portions of said second dielectric sleeve contact the respective first dielectric sleeve and receptacle body, and such that the inner and outer raised annular portions are compressed directly towards each other and substantially uniformly in all radial directions, against said receptacle body, to form a first seal between said first and second dielectric sleeves and a second seal between said second dielectric sleeve and the inner surface of said receptacle body, thereby completing a continuous dielectric seal between the contact pins and said receptacle body, without the necessity of an axial force to maintain the seal.

2. The improvement set forth in claim 1, wherein said second cylindrical dielectric sleeve has a flanged portion to engage a corresponding groove in said insulated body, to prevent inadvertent removal of said second sleeve.

3. The improvement set forth in claim 1 wherein:

said first cylindrical dielectric sleeve encases the first contact pin entirely, except for an end opening to provide access for the second contact pin; and said second cylindrical dielectric sleeve has an open end to permit entry to said first dielectric sleeve, and a closed end with an opening therein for the second contact pin.

4. The improvement set forth in claim 1, and further including means for maintaining the receptacle and plug assemblies in a connected relationship.

5. The improvement set forth in claim 1 wherein the wall thickness of the second dielectric sleeve is at most about one-fourth the inner radius of the sleeve.

6. A high-voltage electrical connector comprising:

a receptacle assembly having at least one generally cylindrical insulated body of relatively non-resilient material, at least one contact pin of a first type supported in said body, and a resilient cylindrical dielectric sleeve fitted in said body and having a relativley thin wall and a closed end with an opening therein to receive said pin, the wall thickness being substantially less than the sleeve's inner radius, said resilient cylindrical dielectric sleeve including a plurality of raised annular portions on both its inner surface and its outer surface, each raised annular portion on the inner surface being located immediately opposite a corresponding raised annular portion on the outer surface, along a line normal to the sleeve axis;

a plug assembly having at least one plug contact pin of a second type sized to couple with said contact pin of the first type, and a relatively non-resilient, smooth cylindrical dielectric sleeve encasing said contact pin of the second type except for an end opening to receive said contact pin of the first type; and means for releasably maintaining said receptacle and plug assemblies in a coupled relationship without application of significant axial force, and wherein said non-resilient cylindrical dielectric sleeve of said plug assembly is dimensioned to slide tightly but easily into said resilient cylindrical dielectric sleeve, such that only the inner and outer raised annular portions of said resilient dielectric sleeve contact said respective non-resilient dielectric sleeve and insulated body, and duch that the inner and outer raised annular portions are compressed directly towards each other and substantially uniformly in all radial directions, to form a first seal between said resilient and non-resilient dielectric sleeves and a second seal between said resilient dielectric sleeve and said insulated body, thereby completing a dielectric seal between said contact pins and said insulated body of said receptacle assembly.

7. A high-voltage electrical connector as set forth in claim 6, wherein said resilient cylindrical dielectric sleeve has an integral flange to inhibit its inadvertent removal from said receptacle assembly.

8. A high-voltage electrical connector as set forth-in claim 6, wherein said means for releasably maintaining said receptacle and plug assemblied in a coupled relationship includes:

a first coupling element secured to said insulated body of said receptacle assembly; and a second coupling element secured to said plug body; and wherein said first and second coupling-elements also serve to provide a grounded electrical connection.

9. A high-voltage electrical connector as set forth in claim 8, wherein:

said first coupling element is a metallic bushing with an external thread; and said second coupling means is a lock nut.

10. A high-voltage electrical connector as set forth in claim 6, wherein:

said non-resilient cylindrical sleeve extends over a portion of an electrical conductor to which said contact pin of the secodd type is connected; and said plug assembly further includes a third dielectric sleeve, positioned between the conductor and said non-resilient sleeve, said third dielectric sleeve also being of resilient material, which is compressed during assembly to complete the seal.

11. A high-voltage electrical connector as set forth in claim 6, wherein the wall thickness of the resilient cylindrical dielectric sleeve is at most one-fourth the inner radius of the sleeve.

12. A high-voltage electrical connector, comprising:

a receptacle assembly having a generally cylindrical hollow insulated body of relatively non-resilient material, a male electrical contact pin supported in said body and extending generally coaxially therein, and a resilient cylindrical dielectric sleeve fitted in said body and having a relatively thin wall and a closed end with an opening therein to receive said pin, the wall thickness being substantially less than the sleeve's inner radius, said sleeve including a plurality of raised annular portions on its inner and outer surfaces, each raised annular portion on the inner surface being directly aligned with a corresponding raised annular portion on the outer surface, along a line normal to the sleeve axis;

a plug assembly having a female electrical contact sized to coupled with said male contact pin, and a relatively non-resilient cylindrical dielectric sleeve encasing said female electrical contact pin except for an end opening to receive said male contact pin; and means for releasably maintaining said receptacle and plug assemblies in a coupled relationship; and wherein said relatively non-resilient sleeve is of a hard smooth material and is dimensioned to fit tightly but easily into said resilient sleeve, such that only the inner and outer raised annular portions of said resilient dielectric sleeve contact said respective non-resilient dielectric sleeve and body, and such that the inner and outer raised annular portions are compressed directly towards each other and substantially uniformly in all radial directions, thereby forming a first seal between said non-resilient and resilient sleeves and a second seal between said resilient sleeve and said insulated body, to complete a reliable dielectric seal between said female electrical contact and said insulated body of said receptacle assembly, without the necessity of an axial force to maintain the seal.

13. A voltage seal for high-voltage electrical connector, said seal comprising:

an inner cylindrical dielectric sleeve of smooth, relatively non-resilient material surrounding a contact pin of a first type;

an outer cylindrical dielectric sleeve of relatively non-resilient material in which is supported a contact pin of a second type connectable to the one of the first type; and an intermediate, thin-walled cylindrical dielectric sleeve of resilient material installed in said outer dielectric sleeve and surrounding the contact pin therein, the intermediate dielectric sleeve's wall thickness being substantially less than its inner radius, said intermediate dielectric sleeve including a plurality of raised annular portions on its inner and outer surfaces, each raised annular portion on the inner surface being directly aligned with a corresponding raised annular portion on the outer surface, along a line normal to the sleeve axis; and wherein said inner dielectric sleeve is dimensioned to slide tightly but easily inside said intermediate dielectric sleeve, such that only the inner and outer raised annular portions of said intermediate dielectric sleeve contact said respective inner and outer dielectric sleeves, and such that the inner and outer raised annular portions are compressed directly towards each other and substantially uniformly in all radial directions, to ensure sealing contact between said inner and intermediate dielectric sleeves and between said intermediate and outer dielectric sleeves, and completing said voltage seal around the contact pins without the necessity of an axial force to maintain the seal.

14. A multi-pin high-voltage electrical connector comprising:

a receptacle assembly having an insulated body of relatively non-resilient material, said body including a plurality of generally cylindrical openings, a plurality of contact pins of a first type, each supported in a separate one of said body openings, and a plurality of resilient dielectric sleeves, each fitted in a separate one of said body openings and having a closed end with an opening therein to receive the corresponding contact pin, each of said resilient dielectric sleeves including a plurality of raised annular portions located on both its inner and outer surfaces, with each raised annular portion on the inner surface being located immediately opposite a corresponding raised annular portion on the outer surface, along a line normal to the sleeve axis;

a plug assembly having a plurality of contact pins of a second type, each sized to couple with a separate contact pin of the first type, and a plurality of relatively non-resilient, smooth dielectric sleeves, each encasing a separate contact pin of the second type except for an end opening to receive the corresponding pin of the first type; and means for releasably maintaining said receptacle and plug assemblies in a coupled relationship without application of significant axial force, wherein said plurality of non-resilient dielectric sleeves of said plug assembly are all dimensioned to slide tightly but easily into their corresponding resilient dielectric sleeves, such that only the inner and outer raised annular portions contact said respective non-resilient dielectric sleeve and insulated body, and such that the inner and outer raised annular portions are compressed directly towards each other and substantially uniformly in all radial directions, to form a first seal between said resilient and non-resilient dielectric sleeves and a second seal between said resilient dielectric sleeve and said insulated body, thereby completing a dielectric seal between each coupled pair of contact pins and the insulated body of said receptacle assembly.

15. A multi-pin high-voltage electrical connector as set forth in claim 14, wherein each of said resilient dielectric sleeves is cylindrical and has a wall thickness substantially less than its inner radius.

16. A multi-pin high-voltage electrical connector as set forth in claim 15, wherein the wall thickness of each of said resilient dielectric sleeves is at most about one-fourth the inner radius of the sleeve.

17. A resilient dielectric sleeve for use in a high-voltage electrical connector to provide a sealing interface between an inner plug assembly having a non-resilient dielectric sleeve and an outer receptacle assembly having a non-resilient, tubular dielectric body, said resilient dielectric sleeve comprising:

a resilient body having a cylindrical wall and an end wall, said resilient body being formed of a dielectric material and being adapted to be received within the non-resilient body of said outer receptacle assembly and to receive the non-resilient sleeve of said inner plug assembly;

an inner raised annular portion located on the inner surface of the resilient body's cylindrical wall; and an outer raised annular portion located on the outer surface of the resilient body's cylindrical wall, directly aligned with the inner raised annular portion along a line normal to the sleeve axis;

wherein the resilient body and inner and outer raised annular portions are sized relative to the non-resilient sleeve of the inner plug assembly and the non-resilient body of the outer receptacle assembly such that only the inner and outer raised annular portions contact the respective non-resilient sleeve and non-resilient body, and such that the inner and outer raised annular portions are compressed directly towards each other and substantially uniformly in all radial directions, to complete an effective dielectric seal between the inner plug assembly and the outer receptacle assembly.

18. A resilient dielectric sleeve as defined in claim 17, including:

a plurality of equal-sized inner raised annular portions located on the inner surface of the resilient body's cylindrical wall; and a plurality of equal-sized outer raised annular portions located on the outer surface of the resilient body's cylindrical wall, each such outer raised annular portion being directly aligned with a corresponding inner raised annular portion.

19. A resilient dielectric sleeve as defined in claim 17, wherein:

the cylindrical wall of said resilient body has a uniform inner radius; and the cylindrical wall of said resilient body has a uniform thickness substantially less than its uniform inner radius.

20. A resilient dielectric sleeve as defined in claim 19, wherein the thickness of the resilient body's cylindrical wall is at most about one-fourth the inner radius of the wall.

* * * * *